US006508159B1

(12) United States Patent
Muirhead

(10) Patent No.: US 6,508,159 B1
(45) Date of Patent: Jan. 21, 2003

(54) HEAT SINK FOR FIREARM BARRELS AND METHOD FOR ATTACHMENT AND USE

(76) Inventor: Todd A. Muirhead, 1743 Rhonda La., Stone Mountain, GA (US) 30087

( * ) Notice: Subject to any disclaimer, the term of this patent is extended or adjusted under 35 U.S.C. 154(b) by 0 days.

(21) Appl. No.: 09/905,616

(22) Filed: Jul. 13, 2001

(51) Int. Cl.[7] ..... F41A 21/24
(52) U.S. Cl. ..... 89/14.1; 89/14.05; 42/76.01
(58) Field of Search ..... 89/14.1, 14.05, 89/15, 16; 42/75.01, 76.01, 76.02; 165/80.1, 177

(56) References Cited

U.S. PATENT DOCUMENTS

| | | | | |
|---|---|---|---|---|
| 621,085 A | | 3/1899 | Hookham | |
| 799,476 A | | 9/1905 | Lehmann | |
| 1,242,890 A | * | 10/1917 | Sheppard | 415/180 |
| 1,351,017 A | | 8/1920 | Blackmore | |
| 1,789,835 A | * | 1/1931 | Pedersen | 165/184 |
| 1,879,603 A | | 9/1932 | Coupland | |
| 2,112,144 A | | 3/1938 | Coupland | |
| 2,287,066 A | | 6/1942 | Rogers | |
| 2,337,840 A | | 12/1943 | Scott-Paine et al. | |
| 2,894,347 A | * | 7/1959 | Woodcock | 42/75.02 |
| 3,118,243 A | | 1/1964 | Manshel | |
| 3,727,513 A | * | 4/1973 | Wicks | 89/14.05 |
| 4,510,843 A | * | 4/1985 | Rabatin | 89/14.4 |
| 4,641,567 A | | 2/1987 | Creedon | |
| 4,841,836 A | | 6/1989 | Bundy | |
| 5,202,530 A | | 4/1993 | Stephens | |
| 5,509,345 A | * | 4/1996 | Cyktich | 42/97 |
| 5,692,334 A | | 12/1997 | Christensen | |
| 5,860,242 A | * | 1/1999 | O'Neil | 42/75.01 |
| 6,095,236 A | * | 8/2000 | Kuhler | 165/11.1 |

FOREIGN PATENT DOCUMENTS

| | | | | |
|---|---|---|---|---|
| DE | DT 2001938 | * | 7/1970 | 89/14 A |

* cited by examiner

*Primary Examiner*—Michael J. Carone
*Assistant Examiner*—Gabriel Sukman
(74) *Attorney, Agent, or Firm*—Barry E. Kaplan, Esq.; Myers & Kaplan

(57) ABSTRACT

A firearm heat sink is provided that may be easily affixed to, and removed from, a firearm. The heat sink is provided with a plurality of cooling fins. In a preferred embodiment, the firearm heat sink is held in place by a cooperating collet and ring on each end of the heat sink. In an alternate embodiment, the firearm heat sink is formed in halves and is mechanically fastened together about the barrel of the firearm. In either embodiment, an underlying heat conducting material optionally may be added to insure a proper thermal path between the firearm and the heat sink.

17 Claims, 6 Drawing Sheets

HEAT SINK FOR FIREARM BARRELS AND METHOD FOR ATTACHMENT AND USE

TECHNICAL FIELD

The present invention relates, generally, to devices intended for the more efficient transfer of heat from firearms; and, more specifically, to an improved heat sink device for mounting upon the barrel of a firearm, along with the method for its attachment and use.

BACKGROUND OF THE INVENTION

Firearms have long had a problem of the barrel becoming overheated when a high number of rounds are fired in rapid succession through the weapon. The barrel absorbs heat primarily from the combustion attendant to the firing of the weapon, and from the heat produced both by the friction of the bullet and of the muzzle gases leaving the barrel. Natural rates of transfer of this heat from the barrel (e.g., by convection, conduction, and radiation), in the absence of forced heat transfer mechanisms, are insufficient to maintain the firearm within an acceptable range of operating temperatures.

Disadvantageously, this heat which is absorbed by the barrel sometimes may lead to heat-induced changes within the metallurgical structure of the barrel. It may warp the barrel, and, thereby, both increase the misfiring rate of the weapon and decrease its accuracy. Additionally, an overheated weapon is difficult to handle, position, and transport. Accordingly, it is desirable to force an increase in the rate of transfer of heat from firearms subject to such conditions.

A variety of inventions have been devised to deal with the problem just described. Several of these devices are intended to be permanently affixed to the firearm, or to be integral to the design of the firearm itself. Some have used water or air to cool the barrel; others have used muzzle gases or a material closely attached to the firearm barrel to conduct heat away from the barrel in an efficient manner.

For example, U.S. Pat. No. 2,337,840 to Scott-Paine teaches a ribbed sleeve that is forced onto the barrel. A cooling jacket surrounds the barrel and ribbed sleeve. The cooling jacket is pressed into the breach at the rear end. At the forward end of the barrel, a spider is threaded onto the end of the ribbed sleeve. A locknut holds the spider in place. This forms a passage through which compressed air may be forced to accomplish cooling of the barrel.

U.S. Pat. No. 1,351,017 to Blackmore teaches a cooling member having radial fins that is attached to the barrel. A tube fits over the cooling member and barrel, leaving a passage. The rearward end of the tube is attached to the firearm. The forward end of the barrel is held in the tube by a coupling device which threads onto the barrel and is pressed into the end of the tube. Holes are formed in the tube and allow air to circulate and, thereby, to cool the firearm barrel.

U.S. Pat. No. 621,085 to Hookham teaches a ribbed, tapered barrel which is fluted toward the breach. The extreme rear end is smooth in order to fit into a bushing, which is contained in the body of the gun. A casing surrounds the barrel, so that a channel is formed between the casing and barrel. Muzzle gases from the gun are forced through the channel and, thereby, cool the gun.

The majority, if not all, of these devices appear to require customization to fit each specific firearm. They do not appear to be easily removed or refitted to a different firearm.

Many also have been dependent on forcing air or water through a cooling channel, sometimes disadvantageously necessitating the use of auxiliary equipment.

It is, therefore, readily apparent that there is a need for an improved firearm heat sink that is easily attached to the barrel of a firearm; that provides for easy removal and refitting to another firearm; and, that is lightweight, easy to manufacture, can be rapidly installed, and will easily adapt to a wide variety of firearms.

BRIEF SUMMARY OF THE INVENTION

Briefly described, in the preferred embodiment, the present invention both overcomes the above-mentioned disadvantages, and meets the recognized needs for such a device, by providing a firearm heat sink which is easily removed from one firearm, and easily refitted to another.

In the preferred embodiment, the present invention uses a collet mechanism to attach the heat sink to the firearm barrel. More specifically, in a preferred embodiment, the present invention comprises a sleeve for overlying a firearm barrel, the sleeve having cooling fins extending longitudinally and equally spaced about the exterior of the sleeve. At each end of the sleeve is a reduced area that is threaded with tapered pipe threads. The reduced area has slots formed therein, parallel to the axis of the sleeve, and preferably equally spaced about the diameter of the sleeve to form a collet. A pair of rings with mating tapered pipe threads similarly overlay the firearm barrel and screw onto both collet ends. As the rings are tightened upon the collets, the tapered pipe threads force the collets to squeeze down onto the barrel; thereby, securing the heat sink to the barrel.

In a first alternate embodiment, the present invention is preferably made in two halves. The halves are screwed together about the barrel of the firearm. More specifically, in a first alternate embodiment, the present invention comprises a sleeve, preferably formed in two halves, resulting in a first tubular half and a second tubular half. The tubular halves, when bolted together, form a sleeve for overlying a firearm barrel. Each tubular half has a plurality of cooling fins extending longitudinally therefrom; and equally spaced about the exterior of the sleeve. Each tubular half is provided with mounting flanges on the outermost edges, parallel to each other, and preferably on a plane with the center-point of the tubular half. The mounting flanges are drilled and tapped so as to allow the tubular halves to be fastened together.

In all embodiments, an underlying heat conduction material may be provided to fill gaps between the barrel and heat sink, and to provide adequate contact therebetween.

Thus, it is an object of the present invention to provide a new and improved heat sink for mounting upon a firearm which can be easily fitted and refitted to a variety of firearms.

It is another object of the present invention to provide a new and improved firearm heat sink which will fit a variety of sizes of firearm barrels.

It is yet another object of the present invention to provide a new and improved firearm heat sink that can be rapidly installed.

It is yet still another object of the present invention to provide a new and improved firearm heat sink which can be easily manufactured.

Other objects, features, and advantages of the present invention will become apparent to those ordinarily skilled in the art by reference to the accompanying Drawing Figures and to the Detailed Description of the Preferred Embodiment presented herein.

BRIEF DESCRIPTION OF THE FIGURES

The present invention will be better understood by reading the Detailed Description of the Preferred Embodiment with reference to the accompanying drawing Figures, in which like reference numerals denote similar structure and refer to like elements throughout, and in which.

DETAILED DESCRIPTION OF THE PREFERRED AND ALTERNATE EMBODIMENTS

In describing the preferred and alternate embodiments of the present invention, as illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar function or functions.

Figure 1:
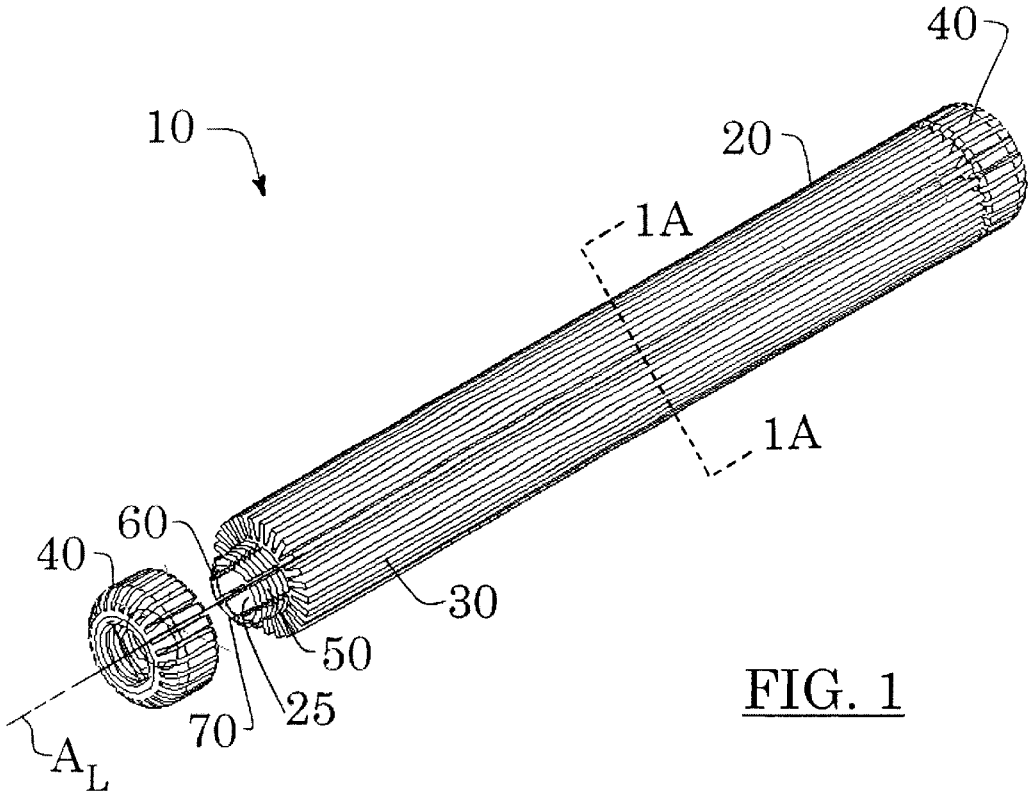
FIG. 1 is a perspective view of the preferred embodiment of the firearm heat sink of the present invention having one ring removed and one ring in place.
Figure 2:
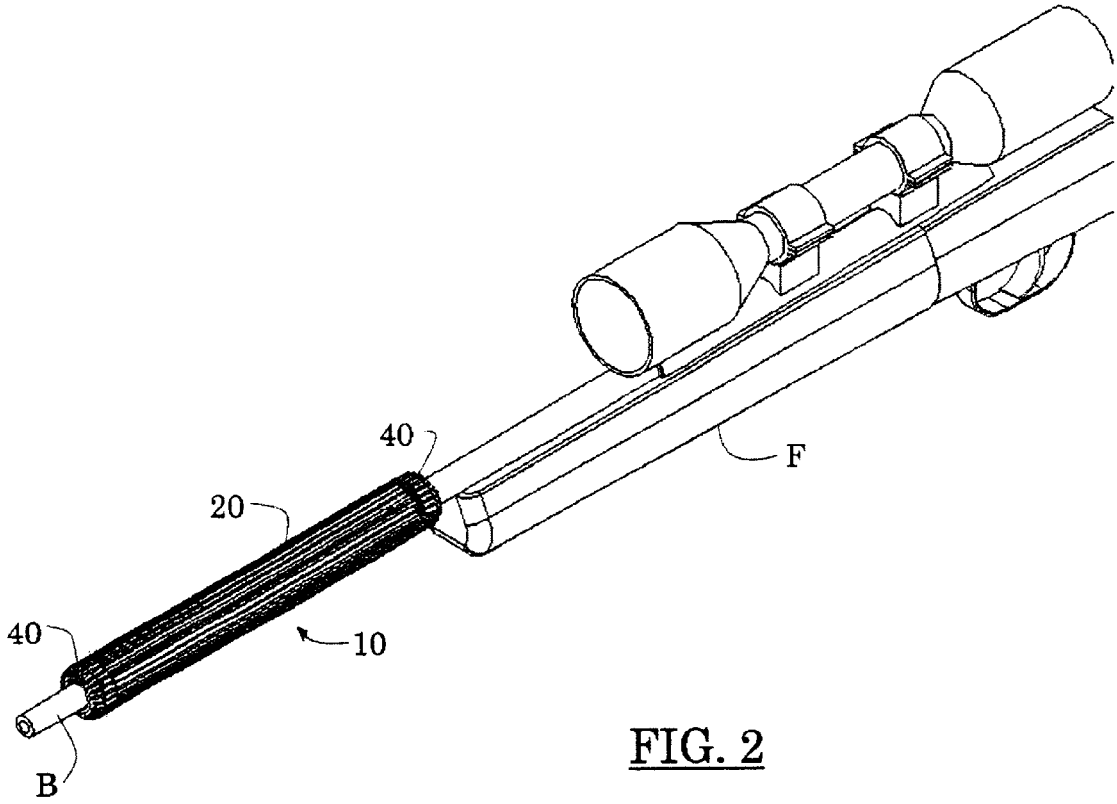
FIG. 2 is a perspective view of the preferred embodiment of the firearm heat sink of the present invention attached to a firearm.

Ref erring first to FIGS. 1 and 2, in a preferred embodiment, firearm heat sink 10 comprises sleeve 20, having bore 25 for overlying at least a portion of the barrel B of a firearm F. Preferably, sleeve 20 is manufactured of a tubular metal extrusion.

A plurality of cooling fins 30 extend about the periphery of sleeve 20, equally spaced about sleeve 20, and parallel with longitudinal axis $A_L$ thereof.

At each end of sleeve 20 are collets 70. Collets 70 have tapered pipe threads 50 and relief slots 60. Collets 70 are of a smaller diameter than the outside diameter of sleeve 20. Relief slots 60 are formed parallel to longitudinal axis $A_L$ of sleeve 20, and are preferably equally spaced about the diameter of collets 70. Relief slots 60 allow for a reduction in the effective diameter of collets 70 through constriction under force applied through tapered pipe threads 50.

Accordingly, in order to constrict collets 70, rings 40 screw onto tapered pipe threads 50 on each end, which results in constriction of tapered pipe threads 50 about the firearm barrel B; thereby, tightly gripping firearm barrel B.

Additionally, it is observed that firearm barrels are often tapered, some more than others. In prior art devices, conventional secondary manufacturing processes were required in order to assure intimate metal-to-metal fit between the barrel and the heat sink device. In such cases, one might machine the internal diameter of the heat sink device,.as by reaming processes or the like.

Rather than to undergo such expensive and extensive processes, customized for each such firearm, it would be preferable to assure that at least one zone at each end of the firearm heat sink is in close and uniform contact with the barrel. Accordingly, the function of collets 70, in addition to the physical securing of firearm heat sink 10 to barrel B, is to insure that there will be a band of metal-to-metal contact on each end of firearm heat sink 10. Such a band of contact provides for and assures adequate heat transfer, without the expense of custom or supplementary machining operations. Since custom operations are not required, a single firearm heat sink 10 may be quickly and easily fit and refit to a wide variety of firearms.

In use, firearm heat sink 10, along with rings 40, are slipped over the barrel B of firearm F, to which firearm heat sink 10 is to be mounted. Rings 40 are tightened snugly, which forces tapered pipe threads 50 to constrict collets 70; thereby, gripping firearm barrel B.

FIG. 2 illustrates firearm heat sink 10 in position on firearm barrel B, with sleeve 20 and rings 40 in position for intended use.

With continuing reference to both FIGS. 1 and 2, it will be apparent to one ordinarily skilled in the art that other methods of constricting collets 70 about firearm barrel B may also be used. For example, a spring, clamp, or snap-locking arrangement may be used. Alternatively, tapered collets and internally tapered rings may be used, the collets and rings having mating threads that may be straight. Similarly, rings 40 may be knurled for ease and convenience of hand-grip fastening. Alternatively, they may have slots cut in them to engage a spanner wrench, or they may have wrench flats or a hex shape, in order to engage a standard wrench.

Collets 70 may be of the same size, or of different sizes, in order to facilitate engagement of a tapered barrel. In addition, bore 25 of sleeve 20 may be straight or tapered in order to better fit a desired firearm barrel.

A plurality of cooling fins 30 preferably run parallel to longitudinal axis $A_L$ of sleeve 20, but may, in an alternate configuration, extend concentrically with respect to bore 25 along the body of sleeve 20. In still another configuration, cooling fins 30 may run in a spiral configuration about the body of sleeve 20.

Figure 1A:
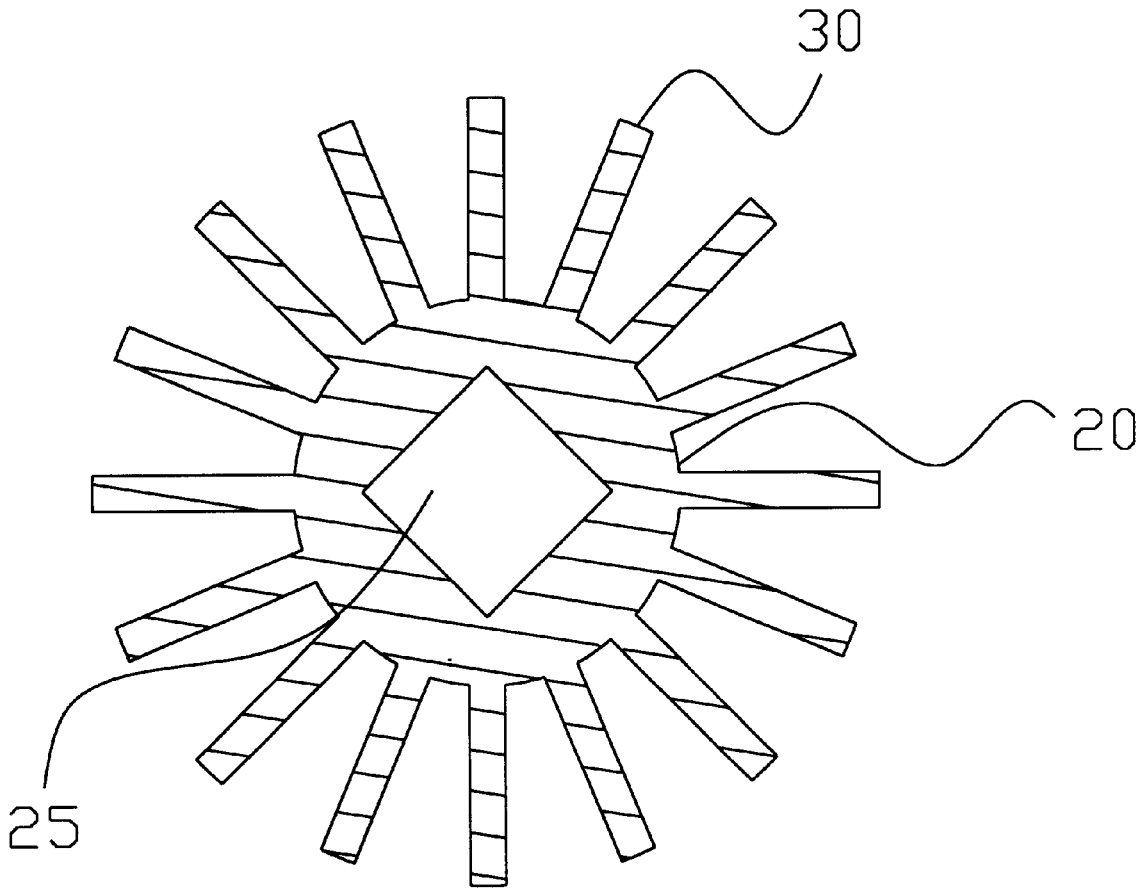
FIG. 1A is a sectional view of the firearm heat sink of the present invention showing a non-round cross-section.

As shown in FIG. 1A, bore 25 of sleeve 20 may be provided in any number of shapes. These include, for example, tapers, ellipses, V-configurations, or any other shape which is suitable to fit a firearm.

Additionally, firearm heat sink 10 may be provided with an underlying heat conduction and gap filling material disposed between firearm heat sink 10 and firearm barrel. B. Such materials may include copper or aluminum foil, or liquids, pastes, or gels, in any form and composition that provides acceptable heat transfer characteristics.

Figure 3:
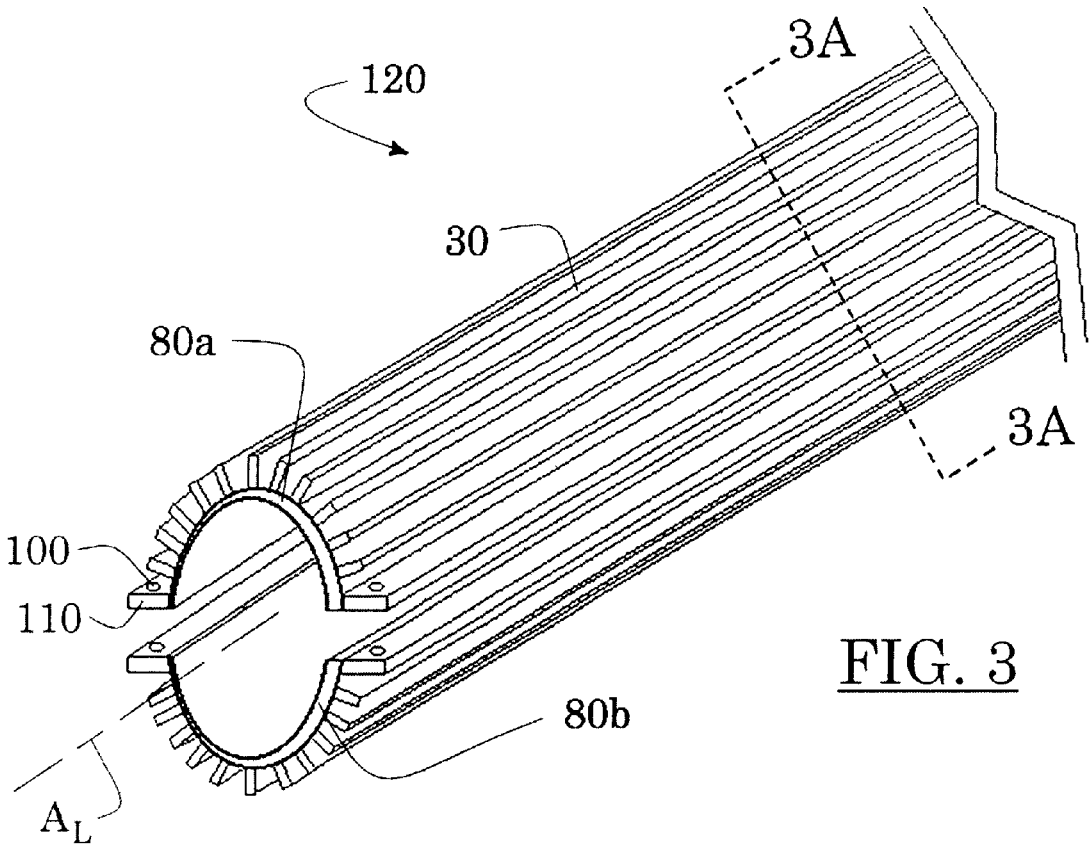
FIG. 3 is a perspective view of the two facing tubular halves of the firearm heat sink of the first alternate embodiment of the present invention; and, FIG. 3A is a sectional view of the firearm heat sink of the first alternate embodiment of the present invention showing a non-round cross-section; and, FIG. 4 is an exploded perspective view of the first alternative embodiment of the present invention, in position to be mounted upon a firearm barrel.
Figure 4:
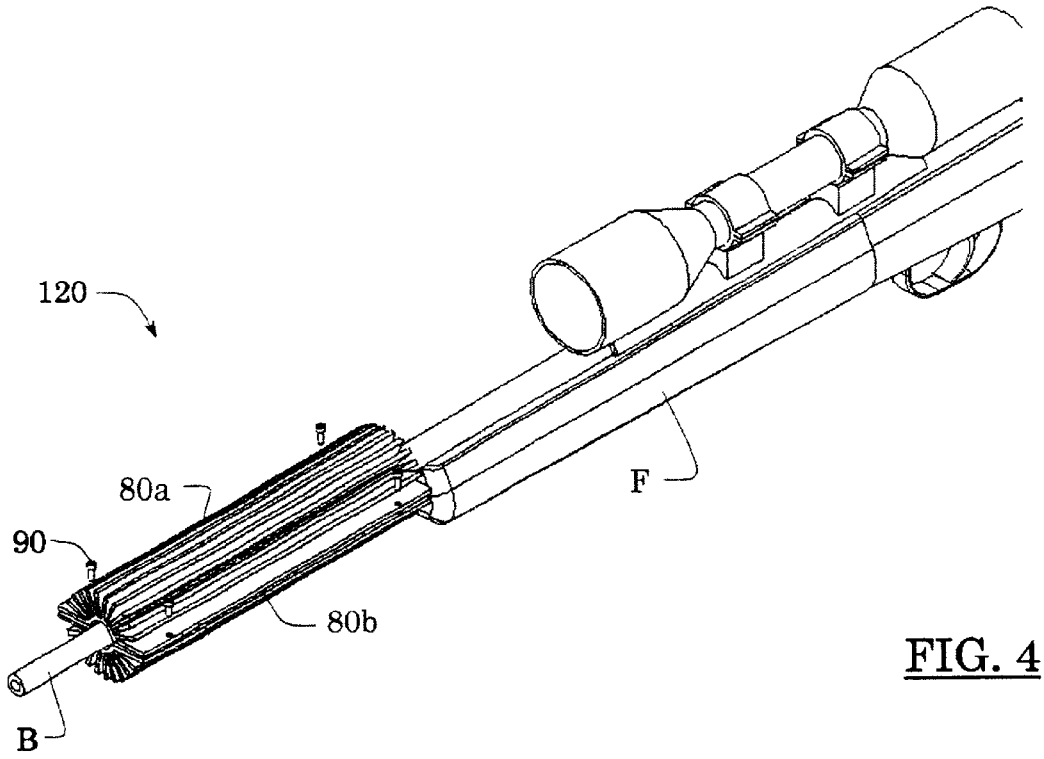

In a first alternative embodiment, shown in FIGS. 3 and 4, firearm heat sink 120 preferably comprises tubular halves 80*a*, 80*b*, a plurality of cooling fins 30, screw holes 100, and mounting flanges 110.

Each tubular half 80*a*, 80*b* is provided with mounting flanges 110 on the outermost edges, parallel to each other, and preferably on a plane with the coextensive center-point of tubular halves 80*a* and 80*b*. Mounting flanges 110 are preferably drilled and tapped, so as to allow tubular halves 80*a*, 80*b* to be fastened together with screws 90.

In use, tubular halves 80*a*, 80*b*, are held in place on firearm barrel B to which they are to be mounted. Screws 90 are then installed in screw holes 100, which holds firearm heat sink 120 securely to barrel B of firearm F. After use, heat sink 120 may be easily and rapidly removed from firearm F and transferred to another firearm. Of course, other means, well known in the art, may be used to fasten together halves 80*a*, 80*b*. Such means may include clamps, threaded collars, or the like.

Cooling fins 30, preferably run parallel to longitudinal axis $A_L$ of firearm heat sink 120, but may, in an alternate configuration, extend concentrically with respect to, and along, the body of firearm heat sink 120. In still another configuration, cooling fins 30 may run in a spiral configuration about the body of sleeve 20.

Figure 3A:
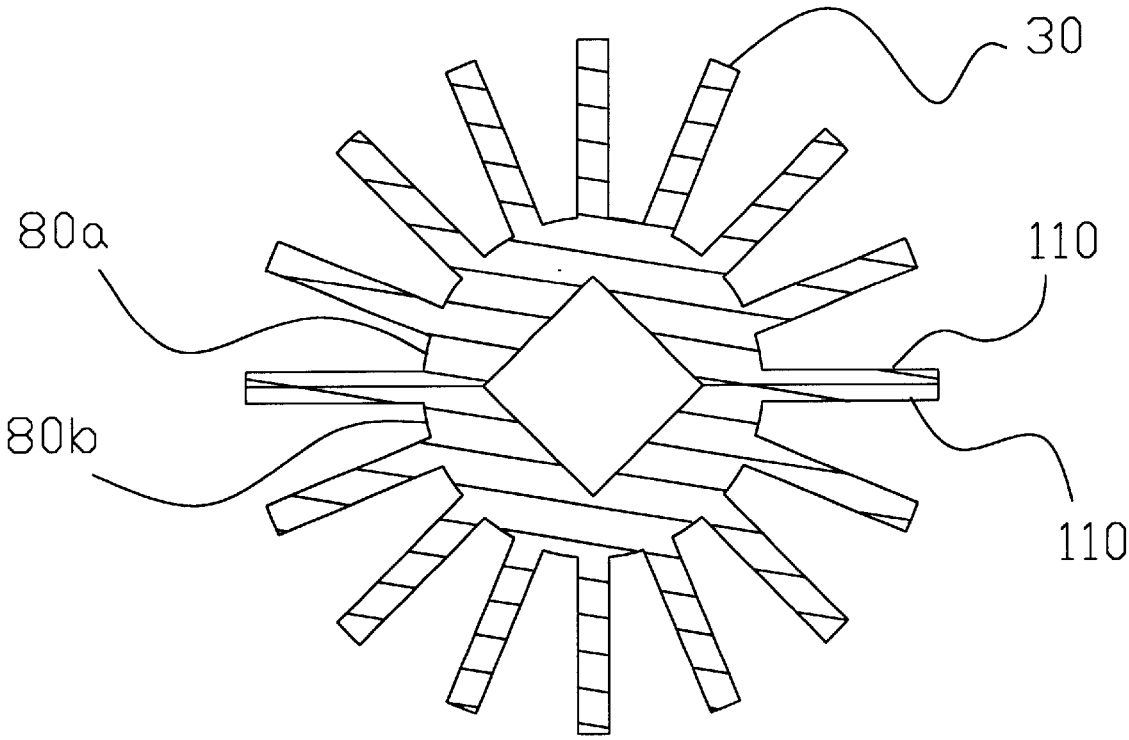

As shown in FIG. 3A, tubular halves 80*a*, 80*b* may also be of a modified circular shape, or a "V" configuration, or any of a variety of other shapes, to allow firearm heat sink 120 to effectively fit a wide range of firearm barrel diameters. Mounting flanges 110 are not required to be in contact with each other, but may have a gap between them.

As with the preferred embodiment, firearm heat sink 120 may be provided with an underlying heat conduction and gap filling material disposed between firearm heat sink 120 and firearm barrel B. Such materials may include copper or aluminum foil, or liquids, pastes, or gels, in any form and composition that provides acceptable heat transfer characteristics.

With regard to all such embodiments and alternatives described herein, the firearm heat sink of the present invention may be manufactured in any number of lengths, so as to provide suitable cooling characteristics to any of a variety of firearms. For example, a shortened firearm heat sink may be used for pistols. An intermediate length firearm heat sink may be utilized on firearms where full length coverage is not desired or is inconvenient, such as to avoid gun sights, scopes, or scope mounts. Of course, a firearm heat sink device which runs approximately the full-length of a firearm barrel would provide maximum cooling effect. Accordingly, a manufacturer or user may choose both the length and position of the firearm heat sink of the present invention, so as to optimally cool the desired area.

With regard to all such embodiments as may be herein described and contemplated, it will be appreciated that optional features, including, but not limited to, aesthetically pleasing coloration and surface design, and labeling and brand marking, may be provided in association with the present invention, all without departing from the scope of the invention.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

I claim:

1. A heat sink for overlying at least a portion of the barrel of a firearm comprising:

a sleeve comprising a collet and an internal diameter;

a plurality of cooling fins extending from said sleeve; and, means for constricting said collet;

whereby said constricting means acts to reduce the effective diameter of said collet; thereby, enabling said sleeve to be attached to the barrel of a firearm.

2. The firearm heat sink of claim 1 wherein said cooling fins extend along said sleeve and run approximately the length thereof.

3. The firearm heat sink of claim 1 wherein said cooling fins extend about said sleeve and are approximately concentric thereto.

4. The firearm heat sink of claim 1 wherein said means for constricting said collet comprises a ring.

5. The firearm heat sink of claim 4 wherein said collet and said ring further comprise cooperating threads.

6. The firearm heat sink of claim 1 wherein said internal diameter is tapered along the length of said sleeve.

7. The firearm heat sink of claim 1 wherein said internal diameter is of non-round cross-section.

8. The firearm heat sink of claim 1 further comprising thermally conductive material for filling a gap between said sleeve and a firearm barrel.

9. A heat sink for overlying at least a portion of the barrel of a firearm comprising:

a sleeve comprising an internal diameter, said sleeve further comprising:

a first end, said first end comprising a first collet;

a second end, said second end comprising a second collet; and, means for constricting each said collet;

whereby said constricting means acts to reduce the effective diameter of each said collet; thereby, enabling said sleeve to be attached to the barrel of a firearm.

10. The firearm heat sink of claim 9 further comprising a plurality of cooling fins extending from said sleeve.

11. The firearm heat sink of claim 10 wherein said cooling fins extend along said sleeve and run approximately the length thereof.

12. The firearm heat sink of claim 10 wherein said cooling fins extend about said sleeve and are approximately concentric thereto.

13. The firearm heat sink of claim 9 wherein said means for constricting each said collet comprises a ring.

14. The firearm heat sink of claim 13 wherein each said collet and said ring further comprise cooperating threads.

15. The firearm heat sink of claim 9 wherein said internal diameter is tapered along the length of said sleeve.

16. The firearm heat sink of claim 9 wherein said internal diameter is of non-round cross-section.

17. The firearm heat sink of claim 9 further comprising thermally conductive material for filling a gap between said sleeve and a firearm barrel.

* * * * *